US010604934B2

(12) United States Patent
De Almeida Borges

(10) Patent No.: US 10,604,934 B2
(45) Date of Patent: Mar. 31, 2020

(54) WIND UPLIFT STRAP AND METHOD FOR INSTALLING THE SAME

(71) Applicant: Carlos Alberto De Almeida Borges, Rio de Janeiro (BR)

(72) Inventor: Carlos Alberto De Almeida Borges, Rio de Janeiro (BR)

( * ) Notice: Subject to any disclaimer, the term of this patent is extended or adjusted under 35 U.S.C. 154(b) by 0 days.

(21) Appl. No.: 16/190,599

(22) Filed: Nov. 14, 2018

(65) Prior Publication Data

US 2019/0177979 A1 Jun. 13, 2019

(30) Foreign Application Priority Data

Dec. 7, 2017 (BR) ..... BR1020170264661

(51) Int. Cl.

| | |
|---|---|
| ***E04D 3/36*** | (2006.01) |
| ***E04D 3/16*** | (2006.01) |
| ***E04D 3/30*** | (2006.01) |
| ***E04D 3/40*** | (2006.01) |

(52) U.S. Cl.
CPC ..... *E04D 3/3605* (2013.01); *E04D 3/16* (2013.01); *E04D 3/30* (2013.01); *E04D 3/3603* (2013.01); *E04D 3/40* (2013.01)

(58) Field of Classification Search
CPC ..... E04D 3/16; E04D 3/3605
See application file for complete search history.

(56) References Cited

U.S. PATENT DOCUMENTS

| | | | | |
|---|---|---|---|---|
| 2,284,898 A * | 6/1942 | Hartman | E04B 1/19 | 52/376 |
| 4,833,844 A * | 5/1989 | Wiklund | E04B 7/08 | 52/533 |
| 4,896,985 A * | 1/1990 | Commins | E04B 1/2612 | 248/544 |
| 5,251,412 A * | 10/1993 | de Almeida Borges | E04B 7/00 | 52/109 |
| 5,273,415 A * | 12/1993 | Jackson | E04G 19/003 | 248/163.1 |
| 5,390,460 A * | 2/1995 | Llorens | E04B 7/20 | 52/489.1 |
| 6,295,780 B1 * | 10/2001 | Thompson | E04B 1/2608 | 52/702 |
| 6,510,666 B1 * | 1/2003 | Thompson | E04B 1/2608 | 52/264 |

(Continued)

FOREIGN PATENT DOCUMENTS

| | | |
|---|---|---|
| BR | PI7805402 | 8/1978 |
| BR | PI8504326 | 4/1987 |

(Continued)

*Primary Examiner* — Beth A Stephan
(74) *Attorney, Agent, or Firm* — Pearne & Gordon LLP

(57) ABSTRACT

A Wind uplift strap for securing a coverage structure. The Wind uplift strap including one or more metal strips having a thickness between 0.50 mm and 1.1 mm, substantially equal to that of the coverage structure, and a width between approximately 15 mm and 50 mm, depending on the load to be supported. The Wind uplift strap having a slightly angled fold in more than 90°, forming a flap at one of its ends. The Wind uplift strap further comprising a main body, a flap, a hole for fixing the flap, a fold line of the flap, and a hole at an end of the main body that is opposite the flap.

2 Claims, 12 Drawing Sheets

(56) References Cited

U.S. PATENT DOCUMENTS

| | | | | |
|---|---|---|---|---|
| 8,806,815 | B1 * | 8/2014 | Liu | H02S 20/23 52/173.3 |
| 8,904,731 | B2 * | 12/2014 | Hohmann, Jr. | E04B 1/4178 52/713 |
| 2018/0155918 | A1 | 6/2018 | De Almeida Borges | |

FOREIGN PATENT DOCUMENTS

| | | |
|---|---|---|
| BR | PI9100456 | 9/1992 |
| BR | PI9304495 | 7/1995 |
| BR | PI9601145 | 1/1998 |
| BR | PI0902183 | 12/2010 |
| BR | 102016014526 | 1/2018 |
| WO | 2011116437 | 3/2010 |
| WO | 2017219104 | 6/2017 |

* cited by examiner

WIND UPLIFT STRAP AND METHOD FOR INSTALLING THE SAME

SUMMARY OF THE INVENTION

The present invention relates to the application of reinforcing devices in a metal coverage to withstand high wind pressures, more specifically a wind uplift strap that is metallic or non-metallic.

BACKGROUND OF THE INVENTION

The device of the present invention directly derives and complements several inventions owned by applicant, the first configuration having been filed with Brazilian Patent Office on Aug. 21, 1978 (PI 7805402-8), the second on Sep. 9, 1985 (PI 8504326-5), the third on Feb. 5, 1991 (PI 9100456-0), the fourth on Nov. 5, 1993 (PI 9304495-0), the fifth on Mar. 27, 1996 (PI 9601145-9), the sixth on Mar. 23, 2009 (PI 0902183-3), and the last on Jun. 20, 2016 (BR102016014526-0)

The first configuration (basic structure) is defined by parts 1—Upper/Lower Chord, part 11—Web diagonals, part 12—Lateral Bracing, part 15—Roof Steel Coil (tile), part 8—'Cover plate'.

From its launch to the present days, the system initially revealed, described above, has about 10 million square meters installed, meeting all the demands and technical requirements requested by the market.

As is generally known, however, the climate is constantly changing throughout the world, changing the scenario of temperatures, rainfall and wind. Nowadays, many of the climate changes are caused by the phenomenon "El Niño" causing droughts or flooding, extreme cold or extreme heat, often in areas that have never experienced such weather conditions.

In the case of wind, it is noted a gradual and constant increase in local average speeds, implying greater pressures to be resisted by the buildings in general, and specifically by roofs and coverages.

Thus, in places where the wind conditions are highly unfavorable, some cases of displacement and even removal of part of coverages were observed. In the case of the object of present invention, displacement and removal of one or more Roof Steel Coils (tiles) were observed.

As shown in FIGS. 1, 2A and 2B, the Roof Steel Coil (15), which acts as a tile in the coverage structure of the present invention, is resiliently contained between the Upper Chord (1) and the Cover plate (8) in its transverse ends (see FIG. 1), without a proper attachment (bolt, rivet etc.) despite the efficient result obtained by the characteristic constructional form of said coverage structure.

For a better understanding of this, a study was made based on Elastic Stability Theory, which clarified the operation of the Roof Steel Coil (tile) (15).

By this theory, the deformation of the Roof Steel Coil (15) caused by a radially distributed stress (FIG. 5) always starts with an inflection point near its center (C), as shown in FIGS. 3 and 4.

However, the theory is difficult to apply since the form and conditions of the theoretical model do not accurately reflect the reality and peculiarities of the coverage to which the object of the present invention is applicable.

Therefore, it was decided to carry out assays for the solution of the problem.

In said tests it has been evidenced that the Roof Steel Coil supports the wind pressure due to its shape and also that its deformation takes place exactly as studied theoretically, that is, deformation of the Roof Steel Coil (tile) has been observed, caused by a distributed stress, started an inflection point near its center (C), as shown in FIGS. 3, 4 and 5.

In a way like the theoretical one, upon deforming, the Roof Steel Coil loses its strength and tends to come out of the support structure, since it is resiliently contained between the Upper Chord (1) and the Cover plate (8) in its transverse ends, keeping the inflection point at the center of the coil (C), as shown in FIG. 4.

Hence, the present invention has been developed, more specifically, a Wind uplift strap (30) which alters the method of securing the Roof Steel Coil (15) of the initially disclosed system, increasing its relative strength.

BRIEF SUMMARY OF THE INVENTION

The Wind uplift strap of the present invention includes a part to be installed at predefined intervals in the longitudinal extension of the coverage structure, connecting it to the Roof Steel Coil (tile) (15) in its final position, and having the object to avoid deformation illustrated in FIG. 4, that is, connecting the Roof Steel Coil (tile) (15) to the structural module, more specifically to a web diagonal (11) as shown in FIGS. 2F and 5.

In the coverage structure and tile of the initially disclosed system the unwrapped sheets are quite long and are subject to significant expansion in the direction of their length, whereby the present invention has been developed to reinforce the Roof Steel Coil (tile) against deformation without preventing said expansion.

Hence, the solution proposed by the present invention is intimately and substantially linked to the proper and particular characteristics of the coverage structure to which it is applied.

LISTING OF ELEMENTS AND/OR COMPONENTS

Figure 1:
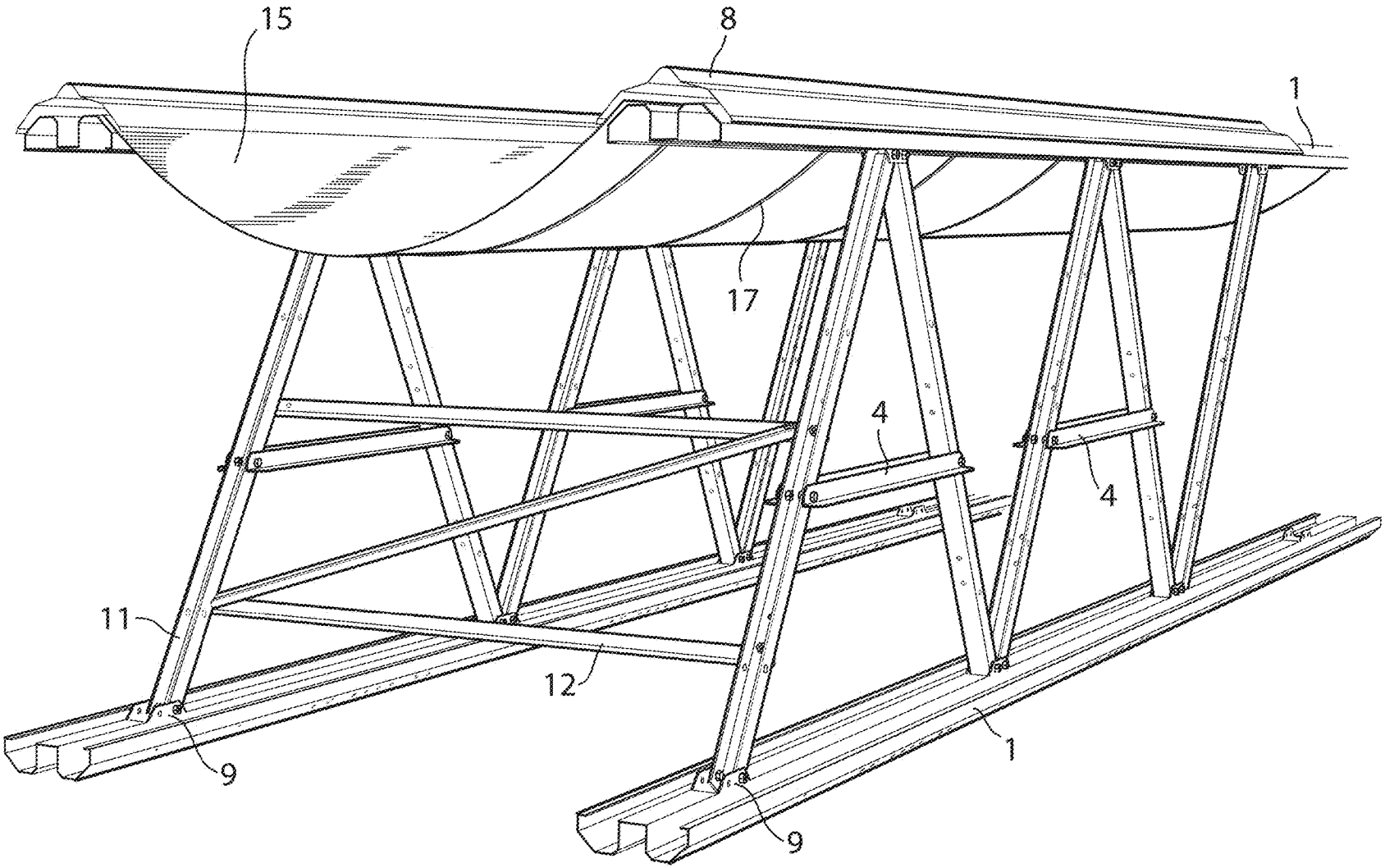
FIG. 1 is a perspective view of a coverage structure (3) of an initially disclosed system, showing a chord (1), web diagonals (11), lateral bracings (12), a cover plate (8), a strap (17), a tile/coverage (15), a diagonal brace (4) and shields (9)
Figure 2A:
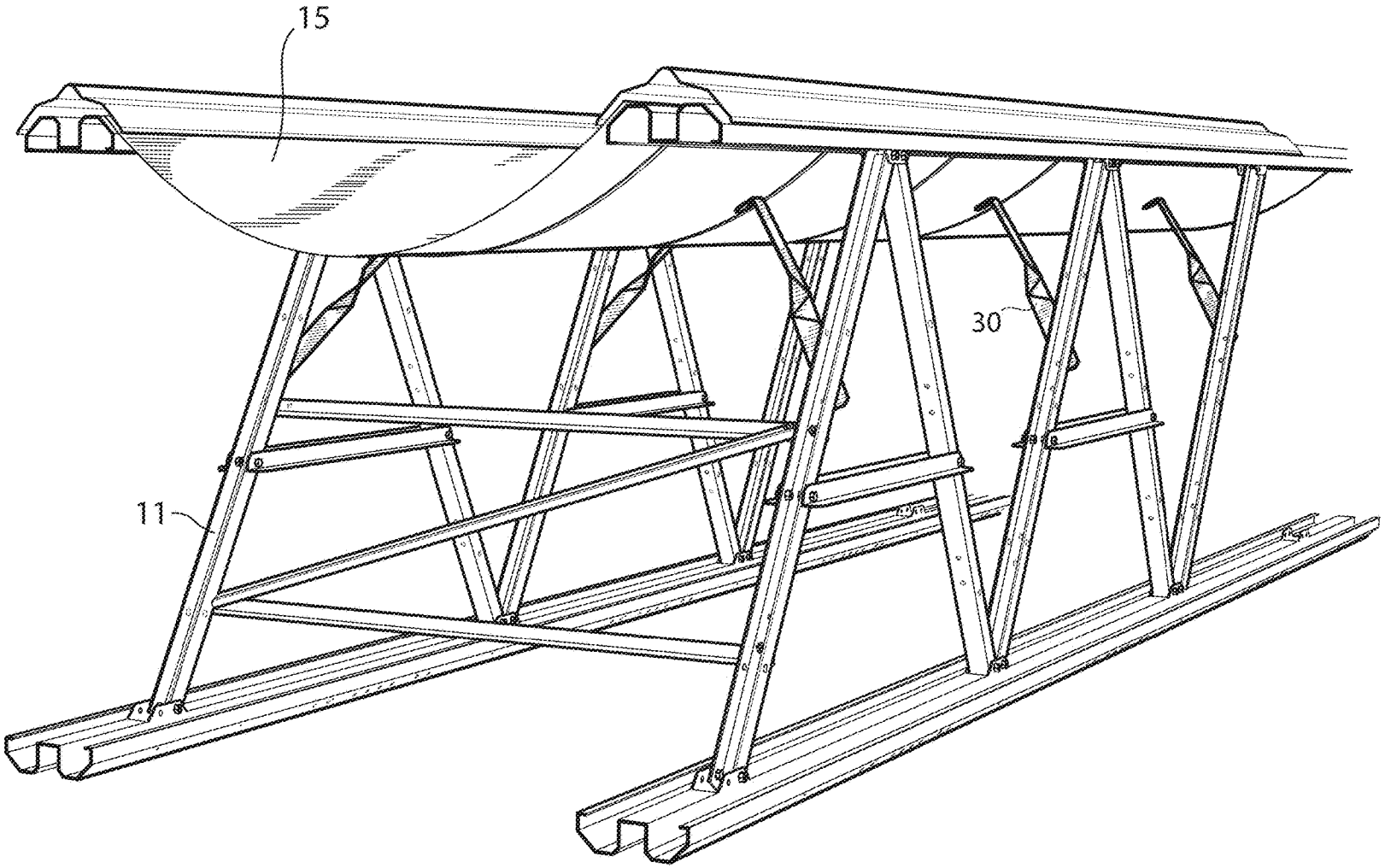
FIG. 2A is perspective view of the coverage structure of FIG. 1 with Wind uplift straps (30), according to the present invention installed, connecting the coil (15) to the corresponding web diagonals (11)
Figure 2B:
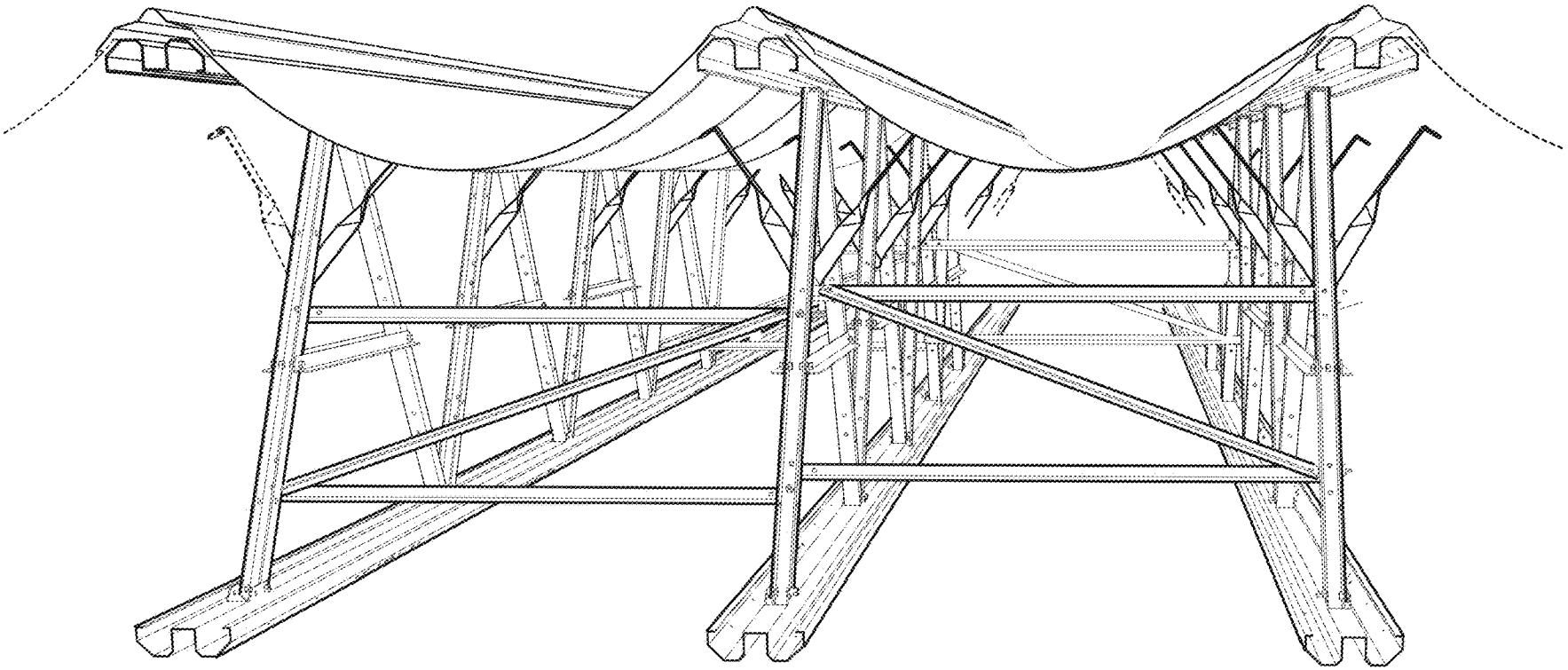
FIG. 2B is a perspective view of a set of beams with Wind uplift straps (30), according to the present invention installed, connecting the coil (15) to the corresponding web diagonals (11), here emphasizing the fact that the same attachment point of Wind uplift strap in the beam may comprise two coil Wind uplift straps contiguous.
Figure 2E:
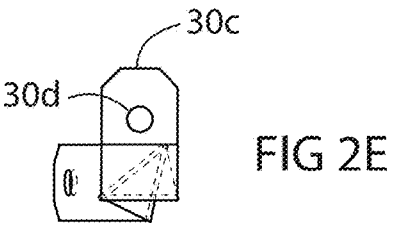
FIG. 2E is a top view of the Wind uplift strap (30) of the present invention, showing the end of the main body (30*a*) comprising the flap (30*c*) which is attachable to the coil (15) shown in FIG. 2A, and showing a first hole (30*d*) of the angled flap (30*c*)
Figure 2D:
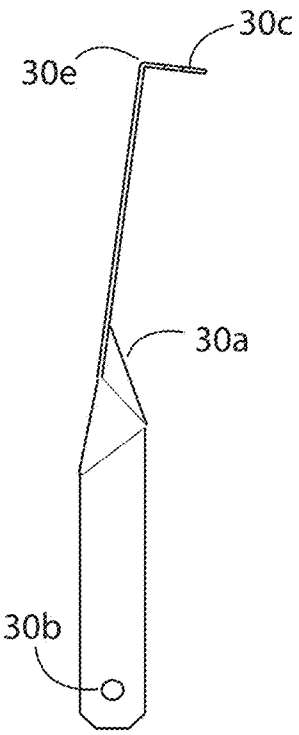
FIG. 2D is a side view of the Wind uplift strap (30) of the present invention, showing a main body (30*a*) and a flap (30*c*) which is attachable to the coil (15) shown in FIG. 2A, and showing a slight angulation of the flap (30*c*), with respect to the body (30*a*), said angulation being suitable for positioning and securing the end of the Wind uplift strap with the flap (30*c*) in the coil 15.
Figure 2C:
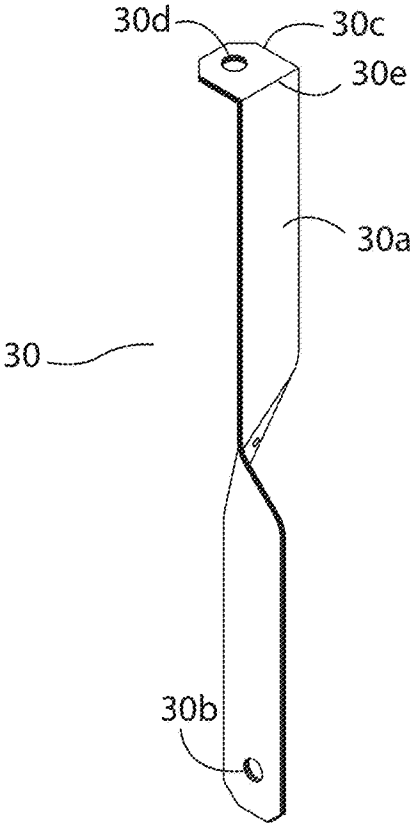
FIG. 2C is a perspective view of a Wind uplift strap (30) of the present invention, showing a main body (30*a*) with an end of the Wind uplift strap (30) comprising a second hole (30*b*) and an opposite end of the Wind uplift strap (30) comprising a flap (30*c*) with a first hole (30*d*) which is attachable to the coil (15) shown in FIG. 2A.
Figure 2F:
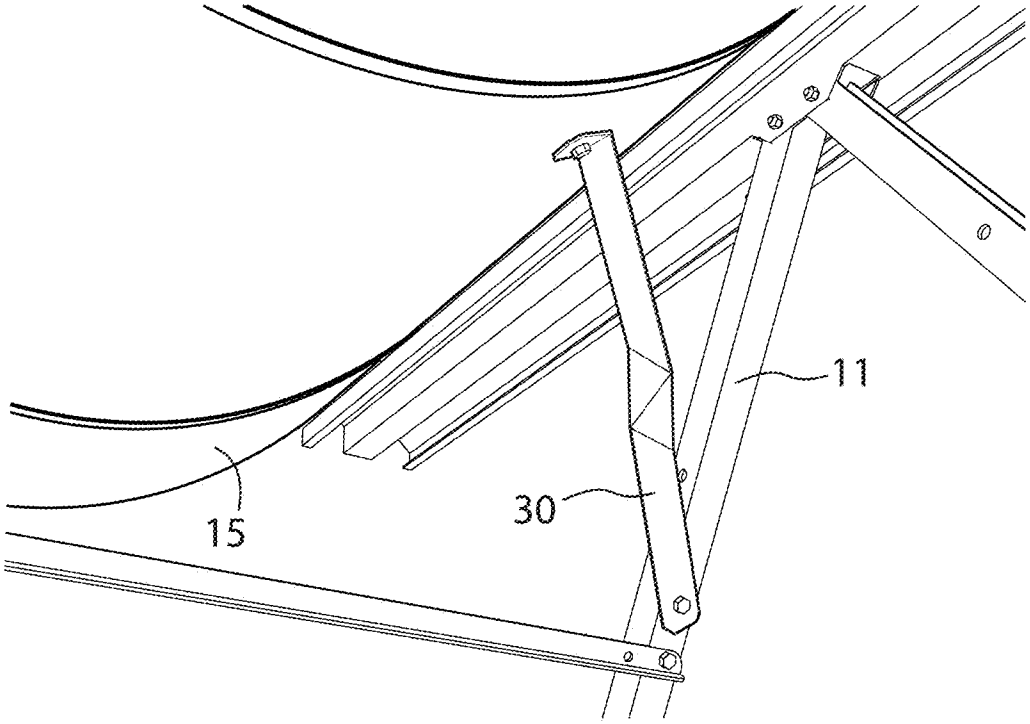
FIG. 2F is a bottom view of part of the coverage structure shown in FIG. 2A with a Wind uplift strap (30) according to the present invention installed, connecting the coil (15) to a corresponding web diagonal (11)
Figure 4:
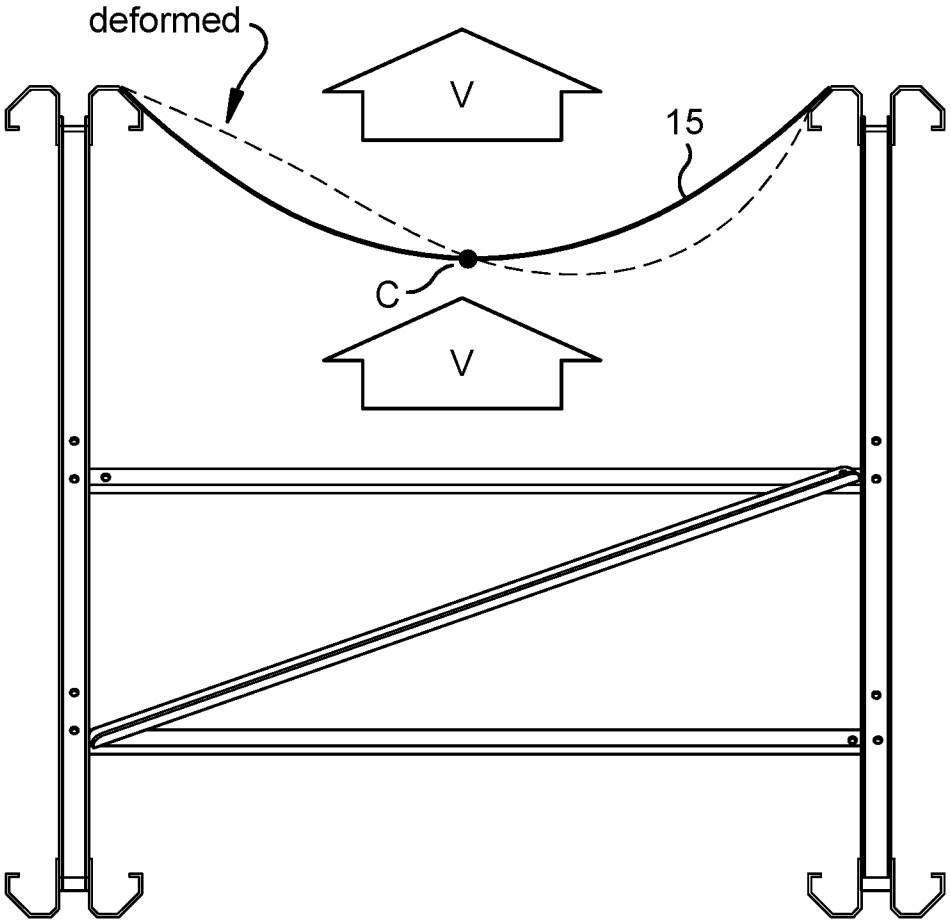
FIG. 4 is an end view of a double beam of a coverage structure with a chord, web diagonals, lateral bracings and a coil (15), showing by vectorization that, under the action of the wind (V) the coil (15) deforms while keeping its center (C) not moving, replicating the effect shown in the graph shown in FIG. 3.
Figure 3:
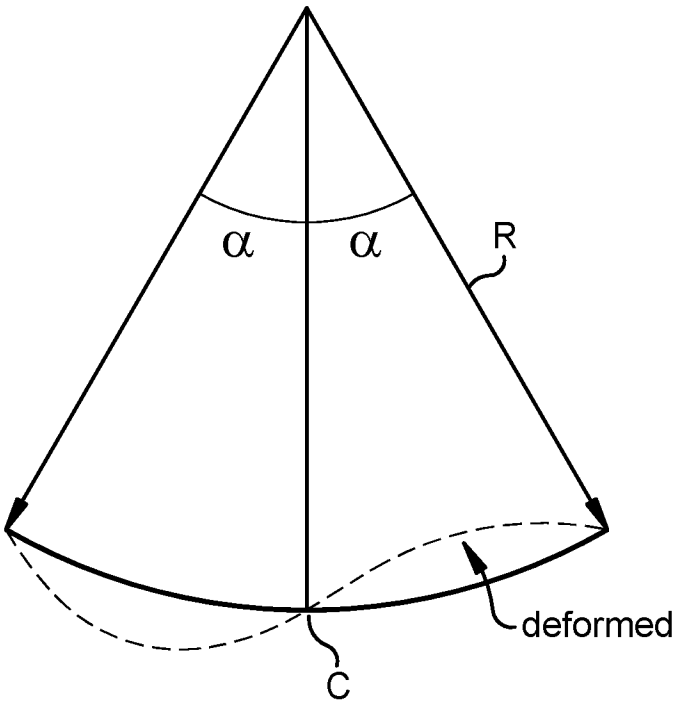
FIG. 3 shows a circular arc of angle 2α and radius R, highlighting a first deformed line (dotted line) of said arc, representative of the coil, which maintains its center point (C) not moving.
Figure 5:
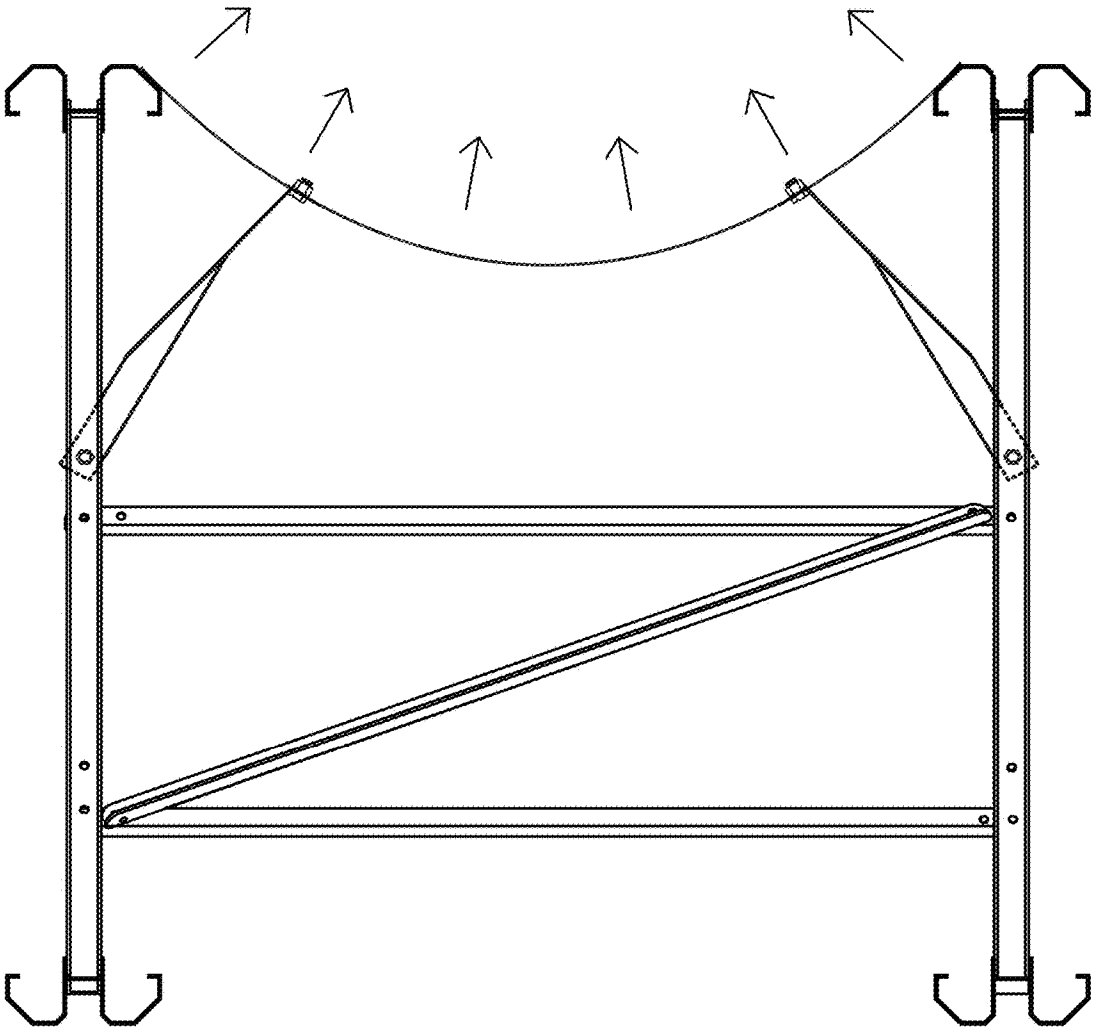
FIG. 5 is an end view of a double beam of the coverage structure with a chord, web diagonals, lateral bracings and a coil, showing by vectorization a stress acting radially on the coil, that is, transversely at each point, the Wind uplift straps of present invention being properly positioned/installed.

For a better understanding of the present invention, the following list of elements and/or components is presented:

1—chord
3—structure (chords+web diagonals+lateral bracings)
4—diagonal brace
8—Cover plate
11—web diagonal
12—lateral bracing
15—coil
17—strap
30—Wind uplift strap
30*a*—main body of Wind uplift strap
30*b*—hole at one end of the Wind uplift strap
30*c*—flap of Wind uplift strap
30*d*—hole of flap of Wind uplift strap
30*e*—folding line of flap of Wind uplift strap

DESCRIPTION OF EXAMPLE EMBODIMENTS

The present invention provides basically a Wind uplift strap (30) depicted in FIGS.(2D, 2D, 2E, and 2F), designed to be applied in accordance with the proper and particular characteristics of the coverage structure (3). The main body (30*a*) of the Wind uplift strap of the present invention includes a fold in the longitudinal extent causing a longitudinal twisting effect of the part.

The Wind uplift strap of the present invention includes a metal strip of thickness between 0.50 mm to 1.10 mm, substantially equal to that of a Roof Steel Coil (tile), and width between approximately 15 mm to 50 mm, depending on the load to be supported. The Wind uplift strap (30) having an angled fold at just over 90°, forming a flap at one of its ends.

For high loads to be supported, the present invention may include a double metal strip, i.e., two equal strips, abutting one another longitudinally, with thicknesses between 0.50 mm to 0.80 mm, preferably 0.65 mm. This embodiment is the preferred one to be used for higher loads because it maintains a pattern of geometry and manufacturing of the part and sheet thickness, the single strip embodiment being used to support lower value loads.

Thus, the following Wind uplift strap members are characterized: the main body (30*a*), a flap (30*c*), a first hole (30*d*), a fixing flap (30*c*), a fold line (30*e*) of the flap, and a second hole (30*b*) of the Wind uplift strap (30) on an end that is opposite the flap (30*c*).

The flap (30*c*) of the Wind uplift strap (30) abuts a Roof Steel Coil (15) in a pre-punctured location. After aligning the first hole (30*d*) of the flap (30*c*) and the corresponding hole of the Roof Steel Coil (15), a bolt with a corresponding nut is used to fasten one to the other. It is important that this flap (30*c*) is perpendicular to the length of the Roof Steel Coil (15), so that its fold enables the Roof Steel Coil (15) to move upwardly during wind action. If it is not placed in this position, the flap (30*c*) of the Wind uplift strap (30) will be much more resistant to the upward displacement, which may cause a rupture (tear) in the Roof Steel Coil (15). Other fasteners are acceptable, with the same or similar effect, such as airtight rivets, clamps, adhesive material, etc.

The end of the main body (30*a*) of the Wind uplift strap (30), opposite the flap (30*c*), includes a second hole (30*b*) which is to be aligned with one of the bores of an adjacent web diagonal (11), said end being secured to the web diagonal (11) by bolt with nut or similar element.

This fastening point of the web diagonal (11) using an existing hole in a structural part provides a desired inclination for the intended purposes of the Wind uplift strap (30), i.e., prevents the Roof Steel Coil (tile) (15) from deforming and coming out of its containment elements (Cover plate (8) and chord (1)), without interfering with the ability to elongated.

Figure 6:
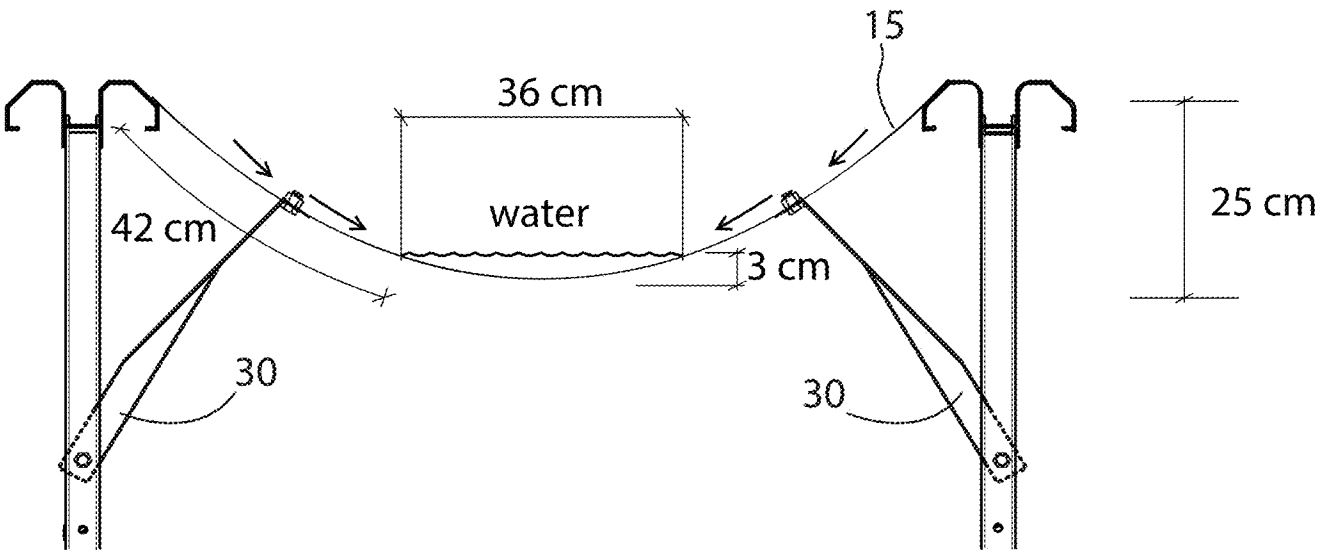
FIG. 6 is an end view of a coil (15) reinforced with the Wind uplift straps (30) according to the present invention, showing the accumulation of water with 3 cm of water depth.
Figure 7:
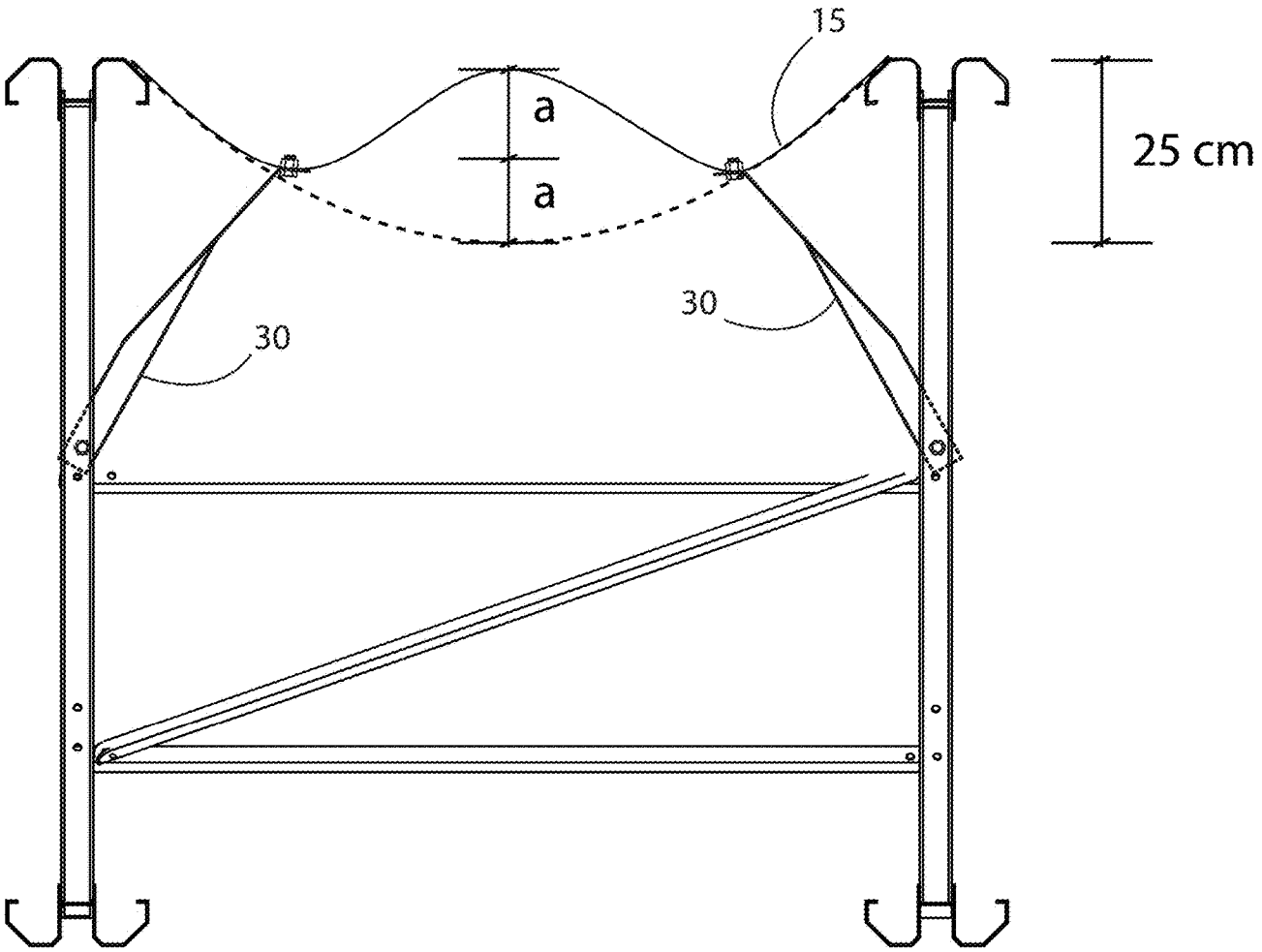
FIG. 7 is an end view of a double beam with the coil (15) reinforced with Wind uplift straps (30) according to the present invention, showing the maximum deformation of said coil, in characteristic plastic representation arising from the application of the Wind uplift straps (30) of present invention.

The definition of the suitable location for the Wind uplift strap (30) to attach to the Roof Steel Coil (tile) (15) follows two guidelines illustrated in FIGS. 6 and 7, namely:

fastening the Roof Steel Coil (tile) (15) so that, upon deforming, it creates a central curvature (FIG. 7); and that this curvature does not exceed the upper level of the chords and prevents infiltration of water (FIG. 6).

As shown in FIG. 7, the desired deformation ratio for the tile (15), obtained from the placement of the Wind uplift straps (30) of the present invention, corresponds to a maximum of 2a (see FIG. 7), where 'a' corresponds to the distance between the lowest point of the coil curvature and the installation line (fixing) of the Wind uplift straps (30) on the coil (15); and '2a' corresponds to the distance between the lowest point of the curvature of the tile (15) and the top line of the upper chords (1) of the structure.

The maximum deformation height was determined considering the need for possibly having over structures above the top of the upper chords, such as walkways and access walkways for cleaning and maintenance, platforms for air-conditioning, ventilation, power generation (photovoltaic) equipment, etc.

Further, the maximum height has been designed to maintain, in the event of maximum deformation, the ability to flow water through channels (see FIG. 7).

Thus, this fastening location of the end to the flap (30*c*) of the Wind uplift strap (30) should approach half the depth of the Roof Steel Coil (tile) (15), as shown in FIG. 6, far from the bottom of the coil (15), where the water flows.

It has been found that, even in torrential rain, the water depth in the coil (15) does not exceed 3 (three) cm in height. To prove this statement, the coil should be considered a collecting chute (gutter).

Then, following the guidelines of NBR 10844—Building installations for rainwater—(Brazilian National Standard)—and taking as reference the rainfall intensity of the city of São Paulo with recurrence of 5 years, it is possible to demonstrate that, for a flow rate with 3 cm of water depth it will be necessary a tile with length of 95 m, namely:

$$Qp = \frac{IxA}{60}$$

Where:
Qp—design flow rate—327.36 l/min
I—rainfall intensity—172 mm/hr.
A—area receiving the rain—1.20 m×95 m=114.00 $m^2$ $$Qb = \frac{K}{n} \times S \times Rh^{\frac{2}{3}} \times i^{\frac{1}{2}}$$

Where:
Qb—flow rate of coil—327.36 l/min
K=unit fit coefficient=60,000
n—rugosity coefficient=0.011
S—area of wet cross-section—0.008256 $m^2$
P—wet perimeter=0.422 m
Rh—hydraulic radius—Rh=S/P=0.0196 m
i—inclination—1%=0.01 m/m
Thus, $$Qp \approx Qb \rightarrow 206.4 \text{ l/min.} \approx 327.36 \text{ l/min.}$$

Since the flow rate of the tile formed by a characteristically arranged coil is practically equal to the flow rate for the previous case (coil having 95 m length, it is verified that the chute formed by the bottom of coil having 3 cm of water depth is enough to withstand an intense rain, with a recurrence of 5 years in the city of S. Paulo.

Therefore, if the fastening of the Wind uplift strap (30) stays at a point outside this area, water infiltration by the fastening point is avoided.

In this way the Wind uplift strap (30) was sized (calculated) from the position defined by the web diagonal hole and half the depth of the Roof Steel Coil (tile) (15).

Several assays were planned to determine how much the Roof Steel Coil (tile) (15) could transfer of load to the Wind uplift strap (30) and how much it would resist.

Tests with coils KM model, that is, 1,200 mm wide (K)—metric system (M)—were performed aiming to resist 1 minute minimum to a pressure of 90 psf (439.2 kg/$m^2$), which is a standard test pressure in international bodies such as FM Global and UL (Underwriters Laboratories).

The tests followed the standard procedure ANSI/FM 4474-2004 (R-2010) American National Standard for Evaluating the Simulated Wind Uplift Resistance of Roof Assemblies Using Static Positive and/or Negative Differential Pressures, which item "Test Performance" is disclosed below.

Test Performance

1—Air is introduced into the chamber so that the internal pressure is increased at a rate of 1.5 psf (0.07 kPa) with a tolerance of ±1 psf (±0.05 kPa) until the pressure reaches 15 psf (pounds per square foot (0.7 kPa) with a tolerance of +2 psf, −0 psf (+0.1 kPa, −0 kPa). This pressure should then be maintained for a period of 60 seconds. During this time the test specimen should be examined to see if it is completely intact to continue the test.

1.1—There may be a mutual agreement between the test contractor and the laboratory performing the test in the sense that the initial threshold of 15 psf (0.7 kPa) is omitted. In this case the initial pressure threshold will be 30 psf (1.4 kPa) with a tolerance of +2 psf, −0 psf (+0.1 kPa, −0 kPa). The following steps are kept unchanged.

2—After these 60 seconds, the pressure should be increased by 15 psf (0.7 kPa), at a rate of 1.5 psf (0.07 kPa) with a tolerance of ±1 psf (±0.05 kPa). When this new mark is reached, the pressure must be maintained for 60 seconds. During this time the test specimen should be examined to see if it is completely intact to continue the test.

3—The sequence described above (item 2) must be repeated until the test specimen collapses, that is, it is no more possible to maintain the pressure under it, or that by agreement between the test contractor and the laboratory that if it is considered to have reached the predetermined goals.

4—Upon completion of the test, the test specimen should be examined and all items that do not conform to the safety or performance of the product should be noted.

5—The results of this test are in levels of 15 psf (0.7 kPa) of resistance to the wind pressure.

6—The final resistance will be the highest value resisted by the test specimen during the full time of 60 seconds and with later continuity of the test.

6.1—If a predetermined resistance is reached, with interruption of the test without collapse, the final resistance will be the maximum value resisted for a full time of 60 seconds.

The tests were performed on equipment formed by a 4.80×2.40 m pressure box without the top (lid). In one end a fan is connected, which inflates the air box. In the other end it is connected a damper, that is, a device that upon closing reduces the air passage, increasing the pressure of the box. The pressure inside the box is measured by three pressure gauges, placed two in the air outlet, one on each side and one in the air inlet. The pressure gauges have dials on two scales—psf (pounds per square foot) and psi (pounds per square inch), which are units also used in international bodies.

The tests consist of securing the structural elements of the system initially disclosed in PI 7805402-8 in the pressure box. On these elements and for the sealing of the box it is placed a plastic film, which covers the entire upper portion as if it were a lid. On this film the Roof Steel Coil (tiles) and the Wind uplift straps are installed connecting each other with the previously determined spacing. In the case of these tests, Wind uplift straps with double metal strip (two strips) with 0.65 mm each were used, spaced apart 1.20 m.

It should be noted that the Wind uplift strap can be made of various materials (aluminum, steel, iron, plastic, etc.) and shapes (Wind uplift strap, wires, cables, straps, chains, etc.), if they meet the stress and resistance requirements foreseen.

The table below shows the main results obtained in tests performed on a 0.65 mm double sheet steel Wind uplift strap.

| DATE OR TEST | COIL THICKNESS | REINFORCEMENT SPACING | FINAL LOAD | COLLAPSE | REMARKS |
|---|---|---|---|---|---|
| Aug. 11/2014 | 0.65 mm | 1.2 m | 90 psf | YES | Collapse in 94 psf. |
| 03404/2016 | 0.65 mm | 1.2 m | 100 psf | NO | — |
| Mar. 7, 2016 | 0.65 mm | 1.2 m | 120 psf | NO | — |
| Mar. 15, 2016 | 0.65 mm | 1.2 m | 90 psf | NO | — |
| Aug. 16, 2016 | 0.65 mm | 1.2 m | 90 psf | YES | Collapse in 100 psf. |
| Aug. 22, 2016 | 0.65 mm | 1.2 m | 90 psf | NO | — |
| Aug. 23, 2016 | 0.65 mm | 1.2 m | 90 psf | NO | — |
| Aug. 26, 2016 | 0.65 mm | 1.2 m | 105 psf | YES | Collapse in 115 psf. |
| Oct. 4, 2016 | 0.50 mm | 1.2 m | 90 psf | NO | |
| Oct. 11, 2016 | 0.50 mm | 1.2 m | 90 psf | YES | |
| Oct. 18, 2016 | 0.50 mm | 1.2 m | 90 psf | NO | |
| Oct. 20, 2016 | 0.50 mm | 1.2 m | 90 psf | NO | |
| Oct. 24, 2016 | 0.50 mm | 1.2 m | 105 psf | YES | Collapse in 115 psf. |

Remark: The Final Load is the highest-pressure value at which the coil has resisted for at least 60 seconds. Sometimes the tests reached higher resistance values but did not hold for 60 seconds.

Figure 8A:
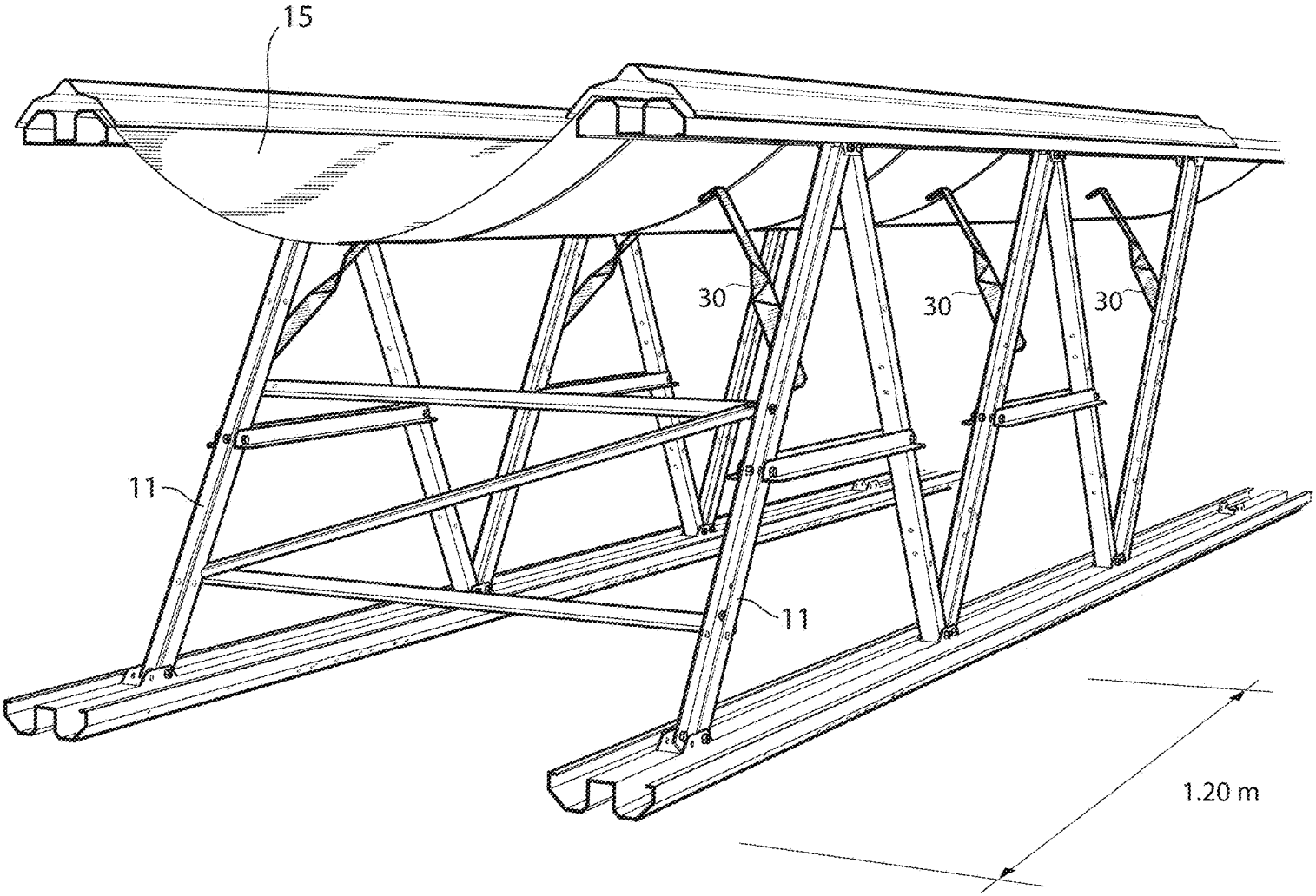
FIGS. 8A, 8B, and 8C are perspective views of a coverage structure with Wind uplift straps (30) according to the present invention installed, connecting the coil (15) to the corresponding web diagonals (11) and showing the spacing of 1.20 m, 2.40 m, and 3.60 between the positions of the Wind uplift straps in the longitudinal direction.
Figure 8B:
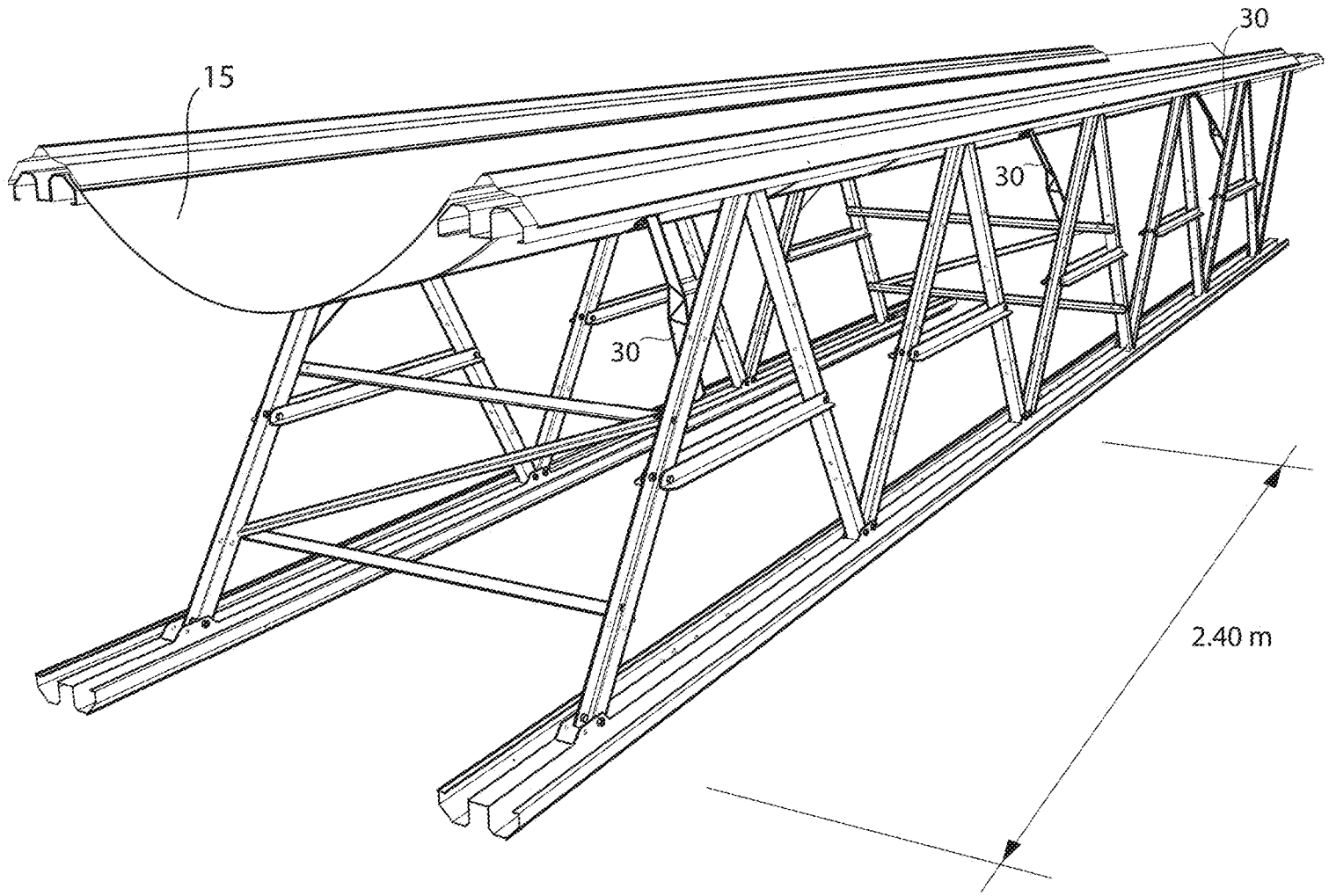
Figure 8C:
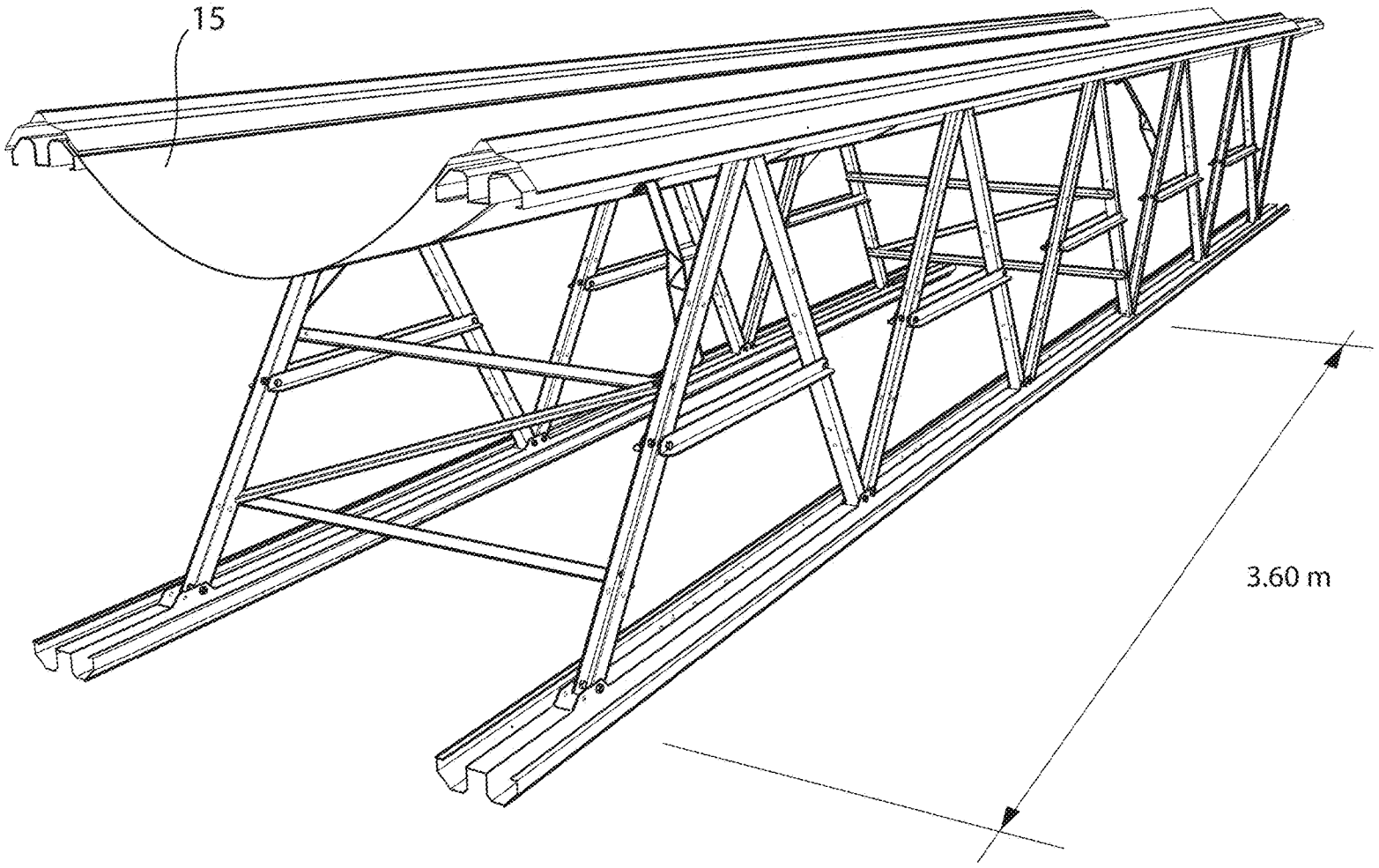

It was concluded from these results that:

with the Wind uplift straps (30) of steel sheet, with double strip, placed each 1.20 m (FIG. 8A) we reach a resistance of minimum 90 psf, that is, 439 kgf/m2. This value represents approximately the pressure of a wind of approximately 84 m/s (302 km/h), a value well above the wind speeds recorded in Brazil, according to ABNT NBR 6123. It corresponds to the speed of a category 5 hurricane (Saffir-Simpson scale) or a F3 tornado (Fujita scale).

the change in thickness of the Roof Steel Coil (tile) from 0.65 mm to 0.50 mm did not change the resistance of the coverage with Wind uplift straps spaced apart 1.20 m.

with changes in the spacings between the Wind uplift straps (FIGS. 8B and 8C), different resistance levels of the Roof Steel Coils (tile) to wind can be reached. The determination of spacing will depend on the need calculated in the design, using larger spans in places with lower intensity wind.

for Roof Steel Coils (tile) (15) of smaller widths, we will certainly have results numerically higher, since the area offered, in view of the radius of curvature, is smaller.

As it is well known to building professionals, the wind does not have the same intensity throughout the entire area of a building.

Similarly, in a roof the wind has zones of greater and smaller suction. With the control of the coil resistance, we can vary the frequency of the Wind uplift straps according to the requirement verified in design.

Characteristic Points:

1—A part or set of joined parts having a shape suitably fit to be fastened to the base structure and to the covering channel originating from uncoiled coil, in defined positions, in a modular way, in such a way that they come into service of resistance under the effect of the wind from of the moment that it reaches a determined condition, producing a rigid fastening for traction purposes, maintaining, however, compatibility with the movement of the coverage channel due to temperature variations.

2—Part or set of parts having geometry and inertia compatible with the need to move radially and resist to tensile stresses, in the form of a strap, cable or chain, or any other composition admitting these movements and resisting to the stresses.

3—Part or set of parts that is fastened to the coverage channel originating from uncoiled coil, in a tight manner and arranged intermittently according to the existing requirements at each application site.

The invention claimed is:

1. A method for installing a wind uplift strap, the wind uplift strap, comprising a main body, a flap, a first hole for fastening the flap, a fold line of the flap, and a second hole on an end of the main body that is opposite the flap, wherein the fold line is a lateral fold of about 90° to form the flap at one end of the main body, the method comprising steps of:

positioning the wind uplift strap relative to a roof steel coil of a coverage structure so that said flap of the wind uplift strap abuts the roof steel coil at a predetermined location, including a corresponding hole for fastening the wind uplift strap to the roof steel coil, aligning the first hole of the flap and the corresponding hole of the roof steel coil, fastening the wind uplift strap to the roof steel coil using a bolt with nut;

and fastening an end of the wind uplift strap to a predetermined hole of an adjacent web diagonal of the coverage structure by aligning the second hole of the wind uplift strap and the predetermined hole of the web diagonal, and securing the wind uplift strap using a bolt with nut.

2. The method according to claim 1, wherein the fold line is parallel to a length of the roof steel coil.

* * * * *